US009379484B2

(12) United States Patent
Phillips et al.

(10) Patent No.: US 9,379,484 B2
(45) Date of Patent: Jun. 28, 2016

(54) LATCH FOR ELECTRICAL CONNECTOR

(71) Applicant: Tyco Electronics Corporation, Berwyn, PA (US)

(72) Inventors: Michael John Phillips, Camp Hill, PA (US); Randall Robert Henry, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/499,465

(22) Filed: Sep. 29, 2014

(65) Prior Publication Data

US 2016/0093978 A1 Mar. 31, 2016

(51) Int. Cl.
*H01R 13/629* (2006.01)

(52) U.S. Cl.
CPC ..... *H01R 13/62905* (2013.01)

(58) Field of Classification Search
CPC ..... H01R 13/6272; H01R 13/6275; H01R 13/62955; H01R 13/6273
See application file for complete search history.

(56) References Cited

U.S. PATENT DOCUMENTS 5,011,424 A * 4/1991 Simmons ..... H01R 13/6275 439/352
5,197,901 A * 3/1993 Hashiguchi ..... H01R 13/6275 439/352
5,383,794 A * 1/1995 Davis ..... H01R 13/6275 439/352
6,592,391 B1 * 7/2003 Wu ..... H01R 13/6275 439/352
6,945,809 B2 * 9/2005 Ishigami ..... G02B 6/4201 439/352
7,226,307 B1 * 6/2007 Chen ..... H01R 13/6275 439/352
7,371,103 B2 * 5/2008 McGrath ..... H01R 12/7005 439/327
7,507,103 B1 3/2009 Phillips et al.
8,169,783 B2 5/2012 Phillips et al.
8,613,630 B2 12/2013 Henry
8,905,442 B2 * 12/2014 Ishigami ..... H01R 13/627 292/128
2010/0087084 A1 * 4/2010 George ..... H01R 13/6275 439/352
2015/0044898 A1 * 2/2015 Dobler ..... H01R 13/6275 439/352

* cited by examiner

*Primary Examiner* — Gary Paumen

(57) ABSTRACT

A latch is provided for latching a connector to a device. The latch includes a body having an actuator and a latch pin. The latch pin is movable between a latched position and an unlatched position. The latch pin is configured to latch the connector to the device when the latch pin is in the latched position. The actuator extends from the latch. The actuator is configured such that movement of the actuator moves latch pin between latched position and the unlatched position. The actuator and the latch pin are integrally fabricated from a same sheet of material as a continuous structure such that the body is a single, unitary body.

20 Claims, 4 Drawing Sheets

LATCH FOR ELECTRICAL CONNECTOR

BACKGROUND OF THE INVENTION

The subject matter described and/or illustrated herein relates generally to electrical connectors, and more particularly to latches for electrical connectors.

Electrical connectors often include latches for latching the electrical connector to another device, such as, but not limited to, another connector, a common housing for a mated pair of connectors, a cage for a pluggable transceiver module, and/or the like. At least some known latches for electrical connectors include auto-return springs that bias the latch to the latched position thereof.

Known latches for electrical connectors are not without disadvantages. For example, at least some known latches for electrical connectors are bulky and may occupy more space than is desired on a housing of the electrical connector. By occupying valuable housing space, such known latches may increase the overall size of the electrical connector, harm the form factor of the electrical connector, and/or harm the aesthetics of the electrical connector. For example, at least some known latches may snag on other objects, structures, and/or the like, for example during mating of the electrical connector with a corresponding mating connector.

BRIEF DESCRIPTION OF THE INVENTION

In an embodiment, a latch is provided for latching a connector to a device. The latch includes a body having an actuator and a latch pin. The latch pin is movable between a latched position and an unlatched position. The latch pin is configured to latch the connector to the device when the latch pin is in the latched position. The actuator extends from the latch. The actuator is configured such that movement of the actuator moves latch pin between latched position and the unlatched position. The actuator and the latch pin are integrally fabricated from a same sheet of material as a continuous structure such that the body is a single, unitary body.

In an embodiment, an electrical connector includes a housing, an electrical contact assembly held by the housing, and a latch mounted to the housing for latching the electrical connector to a device. The latch includes a body having an actuator and a latch pin. The latch pin is movable between a latched position and an unlatched position. The latch pin is configured to latch the electrical connector to the device when the latch pin is in the latched position. The actuator extends from the latch pin. The actuator is configured such that movement of the actuator moves the latch pin between the latched position and the unlatched position. The actuator and the latch pin are integrally fabricated from a same sheet of material as a continuous structure such that the body is a single, unitary body.

In an embodiment, an electrical connector includes a housing having a sidewall. The electrical connector also includes an electrical contact assembly held by the housing, and a latch mounted to the housing for latching the electrical connector to a device. The latch includes a body having an actuator and a latch pin. The latch pin is movable between a latched position and an unlatched position. The latch pin is configured to latch the electrical connector to the device when the latch pin is in the latched position. The actuator extends from the latch pin. The actuator is configured such that movement of the actuator moves the latch pin between the latched position and the unlatched position. The electrical connector includes a return spring operatively connected with the body such that the return spring is configured to bias the latch pin to the latched position. The return spring is embedded within the sidewall of the housing.

DETAILED DESCRIPTION OF THE INVENTION

Figure 1:
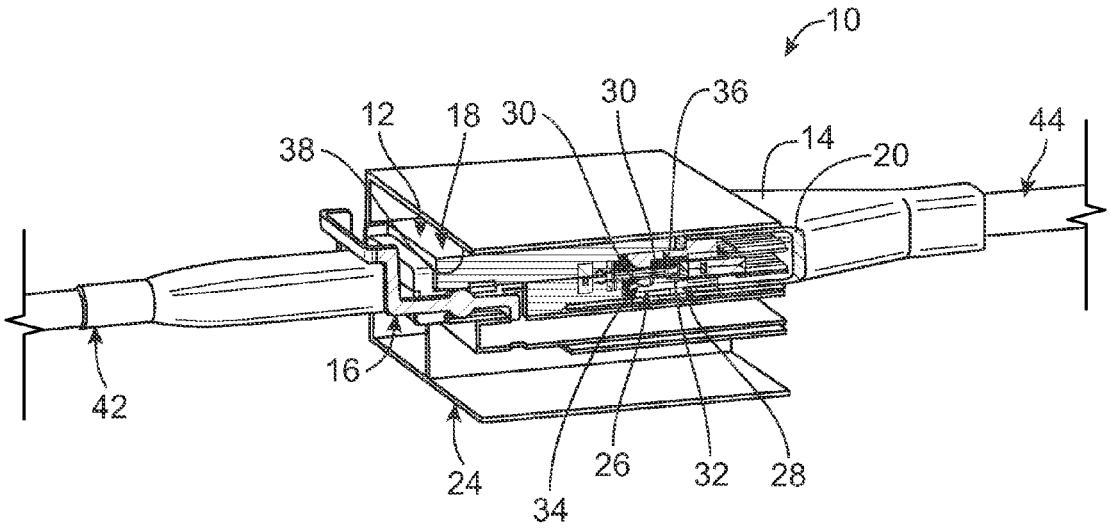
FIG. 1 is a partially cut-away perspective view of an embodiment of an electrical connector assembly.

FIG. 1 is a partially cut-away perspective view of an embodiment of an electrical connector assembly 10. The electrical connector assembly 10 includes electrical connectors 12 and 14 that mate together to establish an electrical connection therebetween. As will be described below, at least one of the electrical connectors 12 and/or 14 includes a latch 16 for latching the electrical connector 12 or 14 to another device, such as, but not limited to, a housing 18 or 20 of the other respective electrical connector 12 or 14, a cage (not shown) of a receptacle assembly (not shown) for a pluggable transceiver module (not shown), a common housing 24 for the electrical connectors 12 and 14, and/or the like.

As shown in FIG. 1, each of the electrical connectors 12 and 14 includes a respective electrical contact assembly 26 and 28 held by the respective housing 18 and 20. When the electrical connectors 12 and 14 are mated together as shown in FIG. 1, the electrical contact assemblies 26 and 28 are engaged in electrical contact with each other to establish the electrical connection between the electrical connectors 12 and 14. Each electrical contact assembly 26 and 28 may include any electrically conductive structure that enables the electrical connectors 12 and 14 to communicate data and/or electrical power therebetween. Examples of such electrically conductive structures include, but are not limited to, electrical signal contacts, electrical ground contacts, electrical power contacts, circuit boards, and/or the like. In the illustrated embodiment, the electrical contact assemblies 26 and 28 include respective electrical contacts 30 and 32 that engage in physical contact with each other to establish the electrical connection between the electrical connectors 12 and 14. Although the electrical contact assembly 26 of the electrical connector 12 is shown as including a plug 34 that is received within a receptacle 36 of the electrical connector 14, additionally or alternatively any other arrangement, configuration, and/or the like may be used.

In some embodiments, the electrical connectors 12 and 14 mate together within and/or on an intermediate structure. For example, in the illustrated embodiment, the electrical connectors 12 and 14 mate together within a corresponding port 38 of the common housing 24. The common housing 24 is optionally shielded (e.g., having at least a portion that is electrically conductive, being electrically connected to a source of electrical ground, and/or the like) to facilitate containing electromagnetic interference (EMI) and/or shielding the electrical connectors 12 and 14 from EMI. Another example of an intermediate structure is a cage for a pluggable transceiver module. In other embodiments, the electrical connectors 12 and 14 mate together without any intermediate structure.

Although each of the electrical connectors 12 and 14 is shown as terminating a respective cable 42 and 44, each electrical connector 12 and 14 may terminate any other device, such as, but not limited to a circuit board and/or the like. For example, in some embodiments the electrical connector 12 may terminate the cable 42, while the electrical connector 14 is mounted on a circuit board (not shown).

Figure 2:
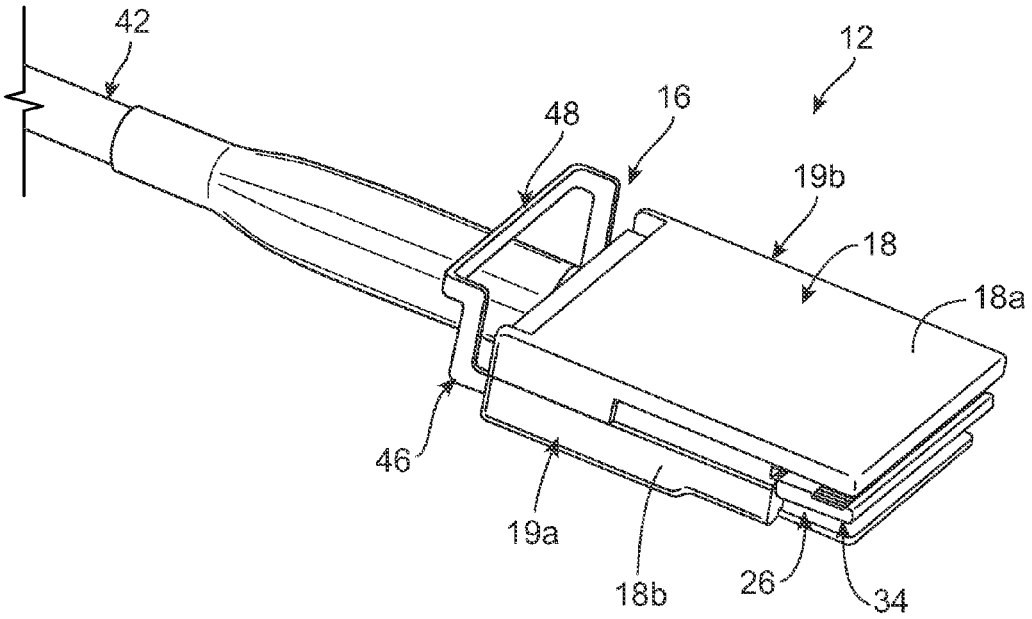
FIG. 2 is a perspective view of an embodiment of an electrical connector of the electrical connector assembly shown in FIG. 1.

FIG. 2 is a perspective view of an embodiment of the electrical connector 12. The electrical connector 12 includes the housing 18 and the electrical contact assembly 26, which as shown in FIG. 2 is held by the housing 18 and includes the plug 34. As is also shown in FIG. 2, the electrical connector 12 terminates the cable 42 in the illustrated embodiment. The electrical connector 12 includes the latch 16. The latch 16 includes a body 46 that is mounted to the housing 18. The body 46 includes an actuator 48. As will be described below, the illustrated embodiment of the latch 16 is a pull latch wherein the actuator 48 is configured to be pulled to unlatch the latch 16.

The housing 18 includes a pair of opposite sidewalls 19*a* and 19*b*. As can be seen in FIG. 2, in the illustrated embodiment, the housing 18 is a two-piece structure that is formed by two shells 18*a* and 18*b* that connect together to define the housing 18. But, the housing 18 may be defined by any number of different structures (e.g., any number of shells and/or the like). In some embodiments, the housing 18 is formed from only a single, unitary structure. As can be seen in FIG. 2, each of the sidewalls 19*a* and 19*b* is defined by a portion of the shell 18*a* and a portion of the shell 18*b* in the illustrated embodiment.

Figure 3:
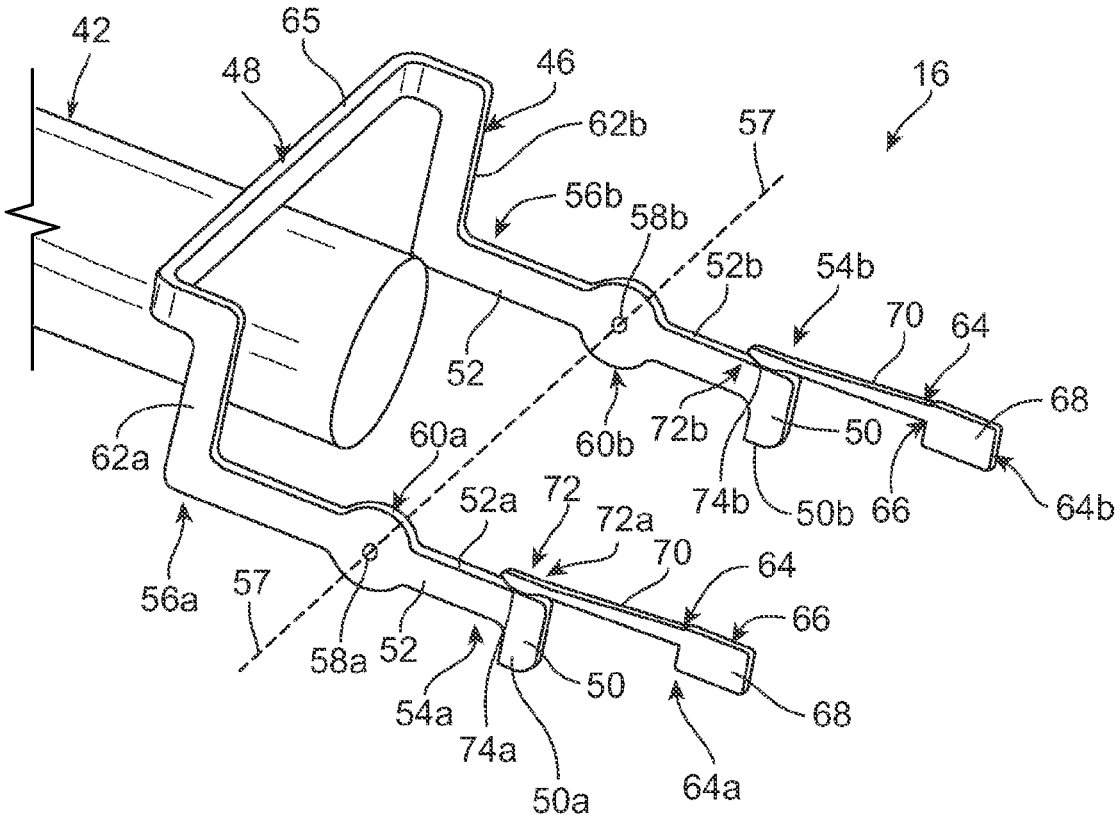
FIG. 3 is a perspective view of an embodiment of a latch of the electrical connector shown in FIG. 2.

FIG. 3 is a perspective view of an embodiment of the latch 16. A portion of the cable 42 is also shown in FIG. 3. The latch 16 includes the body 46, which includes one or more latch pins 50, one or more last arms 52, and one or more of the actuators 48. In the illustrated embodiment, the body 46 includes two latch pins 50*a* and 50*b* and two latch arms 52*a* and 52*b*. Each of the latch pins 50*a* and 50*b* may be referred to herein as a "first" and/or a "second" latch pin. The latch arms 52*a* and 52*b* each may be referred to herein as a "first" and/or a "second" latch arm.

The latch arms 52*a* and 52*b* extend lengths from respective ends 54*a* and 54*b* to respective ends 56*a* and 56*b*. The latch pins 50*a* and 50*b* extend outward at the respective ends 54*a* and 54*b* of the respective latch arms 52*a* and 52*b*. In other words, the latch arms 52*a* and 52*b* extend outward from the respective latch pins 50*a* and 50*b* and from the respective ends 54*a* and 54*b* to the respective ends 56*a* and 56*b*. The latch pins 50*a* and 50*b* are not limited to the geometry (e.g., shape, size, and/or the like) shown herein. Rather, each of the latch pins 50*a* and 50*b* may have any other geometry in addition or alternatively to the geometry shown herein.

As will be described below, the latch pins 50*a* and 50*b* are movable between a latched position and unlatched position. In the illustrated embodiment, the body 46 of the latch 16 is configured to rotate about an axis 57 extending through pivot points 58*a* and 58*b* of the body 46 to thereby rotate latch pins 50*a* and 50*b* (about the respective pivot points 58*a* and 58*b*) between the latched position and the unlatched position. The latch arms 52*a* and 52*b* of the body 46 include respective pivot members 60*a* and 60*b* that cooperate with the housing 18 of the electrical connector 12 to enable the body 46 to rotate about the pivot points 58*a* and 58*b*. Although shown as being located at approximately a center of the lengths of the latch arms 52*a* and 52*b*, the pivot members 60*a* and 60*b* additionally or alternatively may be located at any other location along the length of the respective latch arms 52*a* and 52*b*. In the illustrated embodiment, the pivot members 60*a* and 60*b* are each curved protrusions that are complementary with a corresponding pivot member 77 (shown in FIG. 4) of the housing 18 (shown in FIGS. 1, 2, 4, and 5). Any other arrangements, configurations, geometries, and/or the like may be used in addition or alternative to the illustrated embodiments of the pivot members 60*a* and 60*b*.

In the illustrated embodiment, the actuator 48 extends from the end 56*a* to the end 56*b* of the latch arms 52*a* and 52*b*, respectively. But, additionally or alternatively the actuator 48 may extend from any other location along the lengths of the latch arms 52*a* and 52*b*. The actuator 48 includes base members 62*a* and 62*b* that extend from the latch arms 52*a* and 52*b*, respectively. The actuator 48 includes a bar 65 that extends a length from the base member 62*a* to the base member 62*b*. The bar 65 thus extends between the base members 62*a* and 62*b*. As will be described below, the actuator bar 65 is configured to rotate about the axis 57 to thereby rotate the latch pins 50*a* and 50*b* between the latched and unlatched position. Each of the base members 62*a* and 62*b* may be referred to herein as a "first" and/or a "second" base member.

The various components of the body 46 of the latch 16 are integrally fabricated from the same sheet of material as a continuous structure such that the body 46 is a single, unitary body. For example, the actuator 48, the latch arms 52*a* and 52*b*, and the latch pins 50*a* and 50*b* are integrally fabricated from the same sheet of material as a continuous structure such that the body 46 is a single, unitary body. One example of a process for integrally fabricating the various components of the body 46 from the same sheet of material as a continuous structure includes cutting the body 46 from a sheet of material and forming the cut structure into the finished shape of the body 46 shown herein, which may be referred to herein as a "cut and formed" body. Any cutting process(es) may be used to fabricate the body 46 as a cut and formed body, such as, but not limited to, stamping, laser cutting, water cutting, plasma cutting, cutting using a cutting tool (e.g., a saw, a blade, and/or the like), and/or the like. Moreover, any forming process(es) may be used to fabricate the body 46 as a cut and formed body, such as, but not limited to, compressive forming, tensile forming, combined compressive and tensile forming, bending, shearing, stamping, die forming, forging, indenting, rolling, stretching, expanding, recessing, deep drawing, spinning, flange forming, upset bulging, and/or the like. In some embodiments, the body 46 is a stamped and formed body that is stamped from a sheet of material. In such embodiments wherein the body 46 is a stamped and formed body, any other type and/or number of forming methods optionally may be used in addition to the stamping process (es) to fabricate the body 46 as a stamped and formed body.

Integrally fabricating the various components of the body 46 from the same sheet of material as a continuous structure such that the body 46 is a single, unitary body, for example using a cutting and forming process, may reduce a cost of the electrical connector 12, for example as compared to at least some known electrical connectors that include latches.

The latch 16 includes one or more return springs 64 operatively connected with the body 46 of the latch 16 such that the return spring(s) 64 is configured to bias the latch pins 50*a* and 50*b* to the latched position, as will be described below. The latch 16 may include any number of the return springs 64. In the illustrated embodiment, the latch 16 includes two return springs 64*a* and 64*b*. Each return spring 64 includes a body 66 having a base 68 and a spring finger 70 that extends outward from the base 68 to a free end 72 of the spring finger 70. As will be described below, an engagement surface 74*a* of the free end 72*a* of the return spring 64*a* is configured to engage in physical contact with the latch arm 52*a* to bias the latch pin 50*a* to the latched position. Similarly, an engagement surface 74*b* of the free end 72*b* of the return spring 64*b* is configured to engage in physical contact with the latch arm 52*b* to bias the latch pin 50*b* to the latched position. Any other geometry, configuration, arrangement, type of spring, and/or the like may be used in addition or alternatively to the illustrated embodiment of the body 66 of the return spring 64.

Optionally, the various components of the body 66 of the return spring 64 are integrally fabricated from the same sheet of material as a continuous structure such that the body 66 is a single, unitary body. For example, the base 68 and the spring finger 70 may be integrally fabricated from the same sheet of material as a continuous structure such that the body 66 is a single, unitary body. In some embodiments, the body 66 is a cut and formed body. Moreover, in some embodiments, the body 66 is a stamped and formed body that is stamped from a sheet of material. Optionally, any other type and/or number of forming methods may be used in addition to the stamping process(es) to fabricate the body 66 as a stamped and formed body. Integrally fabricating the various components of the body 66 from the same sheet of material as a continuous structure such that the body 66 is a single, unitary body, for example using a cutting and forming process, may reduce a cost of the electrical connector 12, for example as compared to at least some known electrical connectors that include latches.

Figure 4:
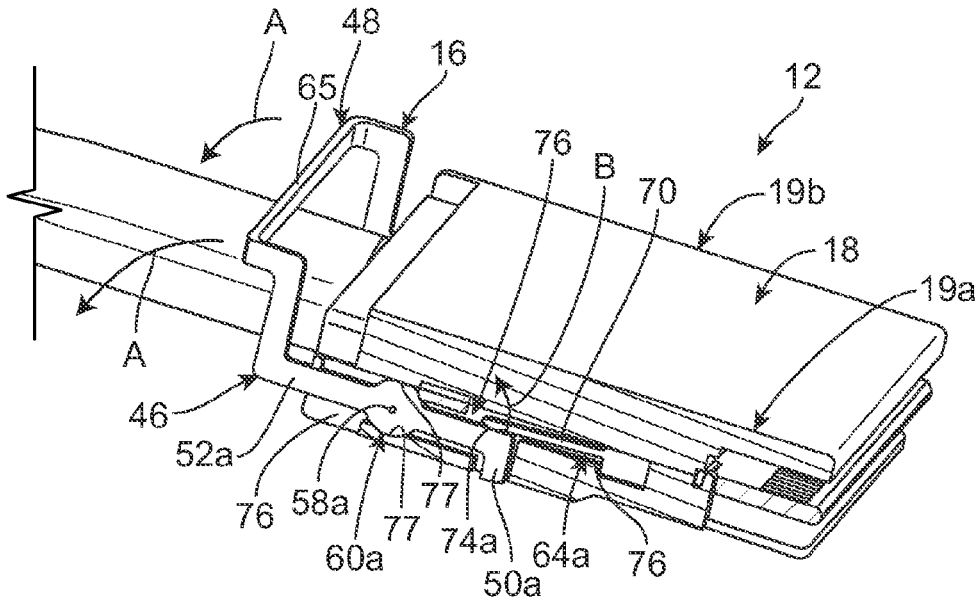
FIG. 4 is a partially cut-away perspective view of the electrical connector shown in FIG. 2 illustrating the latch shown in FIG. 3 mounted thereto.

FIG. 4 is a partially cut-away perspective view of the electrical connector 12 illustrating the latch 16 mounted thereto. The housing 18 has been cut-away in FIG. 4 to illustrate a cross-section of the sidewall 19*a*. As shown in FIG. 4, the sidewall 19*a* includes one or more internal cavities 76. The sidewall 19*a* includes a pivot member 77 that cooperates with the pivot member 60*a* of the latch arm 52*a* to enable the body 46 of the latch 16 to rotate about the pivot point 58*a*. The pivot point 58*a* is defined by a geometric center of the pivot member 60*a*. In the illustrated embodiment, the pivot member 77 is a cradle that is complementary with the pivot member 60*a* for receiving the pivot member 60*a* therein. Any other arrangements, configurations, geometries, and/or the like may be used in addition or alternative to the illustrated embodiment of the pivot member 77.

The return spring 64*a* and at least portions of the latch pin 50*a* and the latch arm 52*a* are held within the internal cavity 76 of the sidewall 19*a*. The pivot member 60*a* of the latch arm 52*a* is received within the cradle of the pivot member 77 such that the body 46 of the latch 16 is configured to rotate about the pivot point 58*a*. As should be appreciated from the above description of the sidewall 19*a* and a comparison of FIGS. 2 and 4, the return spring 64*a* can be considered to be embedded within the sidewall 19*a* because the return spring 64*a* is received within the internal cavity 76 of the sidewall 19*a*. The portions of the latch pin 50*a* and the latch arm 52*a* that extend within the internal cavity 76 of the sidewall 19*a* can also be considered to be embedded within the sidewall 19*a*. As shown in FIG. 4, the engagement surface 74*a* of the spring finger 70 of the return spring 64*a* is engaged in physical contact with the body 46 of the latch 16, and specifically with the latch arm 52*a*, within the internal cavity 76 of the sidewall 19*a*.

The other sidewall 19*b* of the housing 18 is substantially similar to the sidewall 19*a* and therefore will not be described in more detail herein. The return spring 64*b* (shown in FIG. 3) and the latch arm 52*b* (shown in FIG. 3) are received within the sidewall 19*b* in a substantially similar manner as the manner described above with respect to the sidewall 19*a*. The latch arm 52*b* cooperates with the housing 18 at the sidewall 19*b* in a substantially similar manner to the manner described above with respect to the latch arm 52*a*, which enables the body 46 of the latch 16 to rotate about the pivot points 58*a* and 58*b* (shown in FIG. 3).

Embedding the latch arms 52, the latch pins 50, and/or the return springs 64 within the sidewalls 19 may reduce the size of the electrical connector 12, for example as compared to at least some known electrical connectors that include latches. Moreover, embedding the latch arms 52, the latch pins 50, and/or the return spring 64 within the sidewalls 19 may improve the form factor of the electrical connector 12 as compared to at least some known electrical connectors that include latches. For example, embedding the latch arms 52, the latch pins 50, and/or the return spring 64 within the sidewalls 19 may prevent, or reduce the occurrence of snagging the electrical connector 12 on other objects, structures, the common housing 24 (shown in FIG. 1) and/or the like. Embedding the latch arms 52, the latch pins 50, and/or the return springs 64 within the sidewalls 19 may improve the aesthetics of the electrical connector 12 as compared to at least some known electrical connectors that include latches.

The latch pins 50*a* and 50*b* (shown in FIG. 3) are shown in the latched position in FIG. 4, with the spring fingers 70 of the return springs 64*a* and 64*b* (shown in FIG. 3) in the natural resting positions thereof. As shown in FIG. 4, when the spring finger 70 is in the natural resting position, the engagement surface 74 of the spring finger 70 is engaged in physical contact with the corresponding latch arm 50 such that the spring finger 70 biases the corresponding latch pin 50 to the latched position.

To move the latch 16 from the latched position shown in FIG. 4 to the unlatched position, the actuator bar 65 is pulled in the general direction of the arc A such that the actuator 48 rotates about the pivot points 58*a* and 58*b* along the arc A, which rotates the latch pins 50*a* and 50*b* against the bias of the spring fingers 70 and about the pivot points 58*a* and 58*b* along the arc B from the latched position to the unlatched position. The latch 16 is thus a pull latch wherein the actuator 48 is configured to be pulled to unlatch the latch 16. The actuator bar 65 may be pulled in the direction of the arc A using any portion of a person's hand (e.g., a finger, thumb, and/or the like) and/or using a suitable tool. In other embodiments, the actuator 48 is configured to be pushed to unlatch the latch 16 such that the latch 16 is a push latch (e.g., see the latch 116 shown in FIGS. 6-8).

Figure 5:
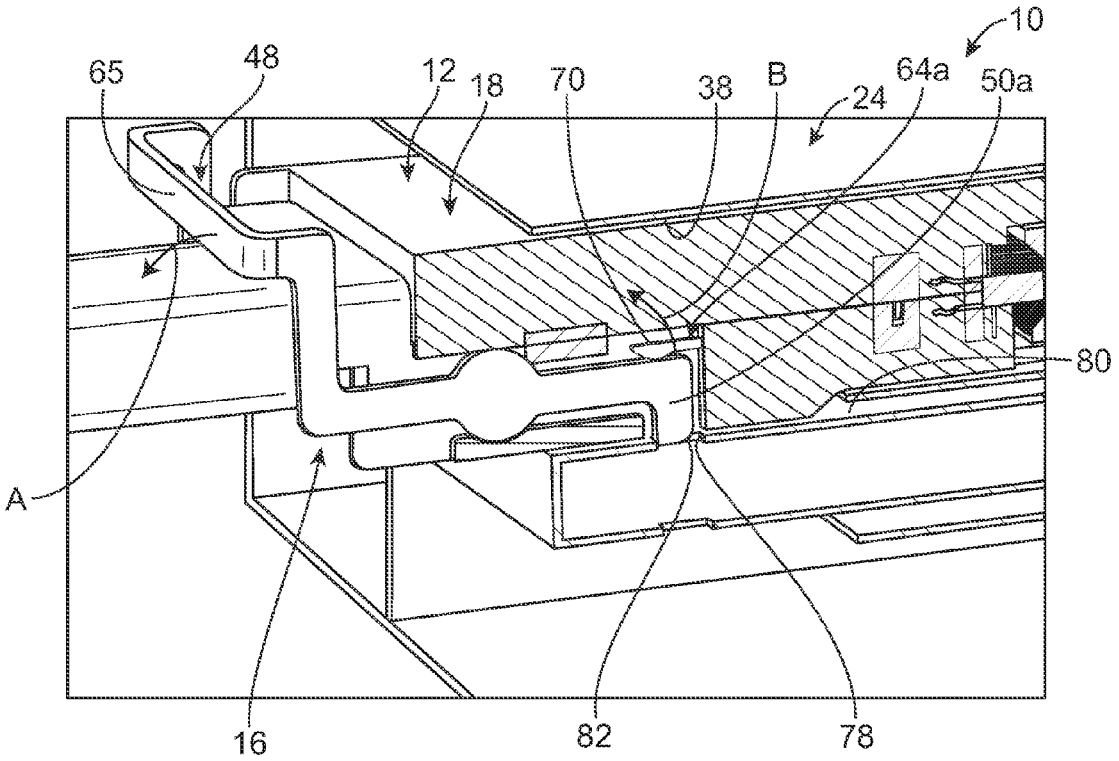
FIG. 5 is a partially cut-away perspective view illustrating a cross-section of a portion the electrical connector assembly shown in FIG. 1.

FIG. 5 is a partially cut-away perspective view illustrating a cross-section of a portion of the electrical connector assembly 10. The electrical connector 12 is shown in FIG. 5 as plugged into the corresponding port 38 (not shown in FIG. 4) of the common housing 24 (not shown in FIG. 4). As shown in FIG. 5, the latch pin 50*a* is received within a latch opening 78 of a wall 80 of the common housing 24 when the latch pin 50*a* is in the latched position. The reception of the latch pin 50*a* within the latch opening 78 latches the electrical connector 12 as plugged into the corresponding port 38 (and facilitates retaining, or latching, the electrical connector 12 as mated to the electrical connector 14 shown in FIG. 1).

Although not visible in FIG. 5, the latch pin 50*b* (shown in FIG. 3) is received within a corresponding latch opening 78 of the wall 80 of the common housing 24 in a substantially similar manner to the manner described and illustrated herein with respect to the latch pin 50*a*.

The latch 16 can be unlatched using the actuator 48 to remove the electrical connector 12 from the port 38 and thereby de-mate the electrical connector 12 from the electrical connector 14. Specifically, the actuator bar 65 can be pulled in the general direction of the arc A such that the actuator 48 rotates along the arc A, which rotates the latch pins 50*a* and 50*b* (against the bias of the return springs 64*a* and 64*b*) along the arc B from the latched position to the unlatched position of the latch 16.

To plug the electrical connector 12 into the corresponding port 38, the actuator bar 65 can be held against the bias of the return springs 64*a* and 64*b* (shown in FIG. 3) to retain the latch pins 50*a* and 50*b* in the unlatched position as the electrical connector 12 is inserted into the port 38. Additionally or alternatively, engagement in physical contact with the wall 80 may move the latch pins 50*a* and/or 50*b* away from the latched position, against the bias of the return springs 64*a* and 64*b*, as the electrical connector 12 is inserted into the port 38. Once the electrical connector 12 has been inserted sufficiently deep into the corresponding port 38, the return springs 64*a* and 64*b* force the latch pins 50*a* and 50*b* into the corresponding latch openings 78. Optionally, the latch pin 50*a* and/or 50*b* includes a ramp surface 82 to facilitate engagement with the wall 80.

In the illustrated embodiment, the latch 16 latches the electrical connector 12 to the common housing 24. But, the latch 16 may latch the electrical connector 12 to any other device, such as, but not limited to, the housing 20 (shown in FIG. 1) of the electrical connector 14, a cage, and/or the like.

Figure 6:
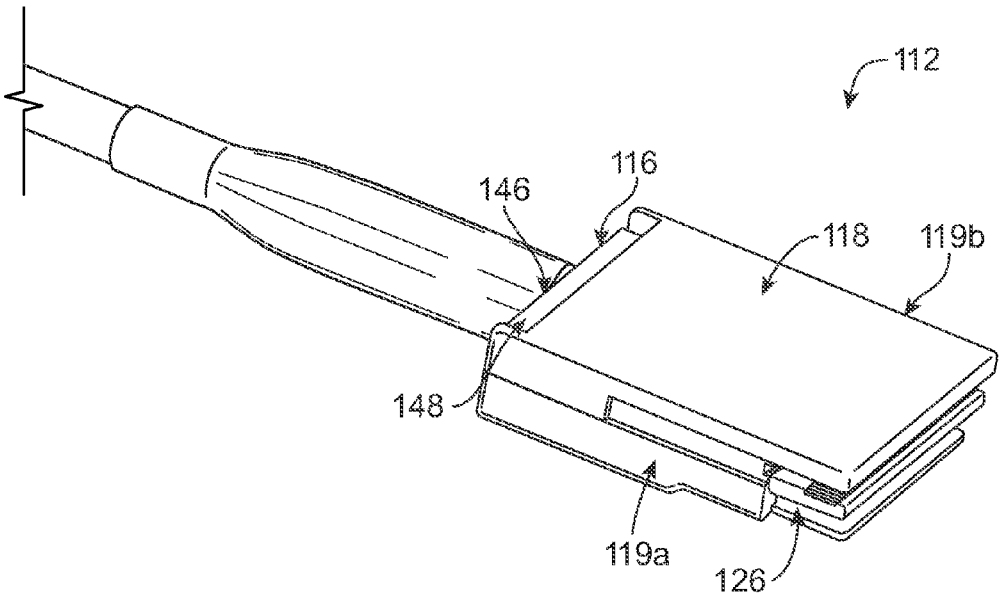
FIG. 6 is a perspective view of another embodiment of an electrical connector of the electrical connector assembly shown in FIG. 1.

FIG. 6 is a perspective view of another embodiment of an electrical connector 112 illustrating another embodiment of a latch 116. The electrical connector 112 includes a housing 118 and an electrical contact assembly 126, which is held by the housing 118. The housing 118 includes a pair of opposite sidewalls 119*a* and 119*b*. The latch 116 includes a body 146 that is mounted to the housing 118. The body 146 includes an actuator 148. The latch 116 is a push latch wherein the actuator 148 is configured to be pushed to unlatch the latch 116.

Figure 7:
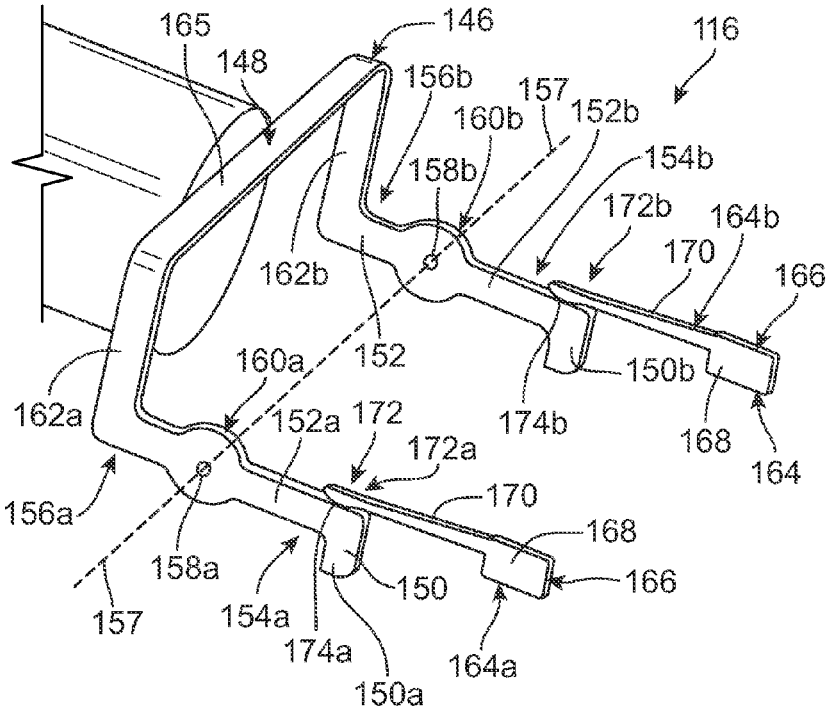
FIG. 7 is a perspective view of an embodiment of a latch of the electrical connector shown in FIG. 6.

FIG. 7 is a perspective view of an embodiment of the latch 116. The latch 116 includes the body 146, which includes one or more latch pins 150, one or more latch arms 152, and one or more of the actuators 148. In the illustrated embodiment, the body 146 includes two latch pins 150*a* and 150*b* and two latch arms 152*a* and 152*b*. Each of the latch pins 150*a* and 150*b* may be referred to herein as a "first" and/or a "second" latch pin. The latch arms 152*a* and 152*b* each may be referred to herein as a "first" and/or a "second" latch arm.

The latch arms 152*a* and 152*b* extend lengths from respective ends 154*a* and 154*b* to respective ends 156*a* and 156*b*. The latch pins 150*a* and 150*b* extend outward at the respective ends 154*a* and 154*b* of the respective latch arms 152*a* and 152*b*. In other words, the latch arms 152*a* and 152*b* extend outward from the respective latch pins 150*a* and 150*b* and from the respective ends 154*a* and 154*b* to the respective ends 156*a* and 156*b*. The latch pins 150*a* and 150*b* are not limited to the geometry (e.g., shape, size, and/or the like) shown herein. Rather, each of the latch pins 150*a* and 150*b* may have any other geometry in addition or alternatively to the geometry shown herein.

The latch pins 150*a* and 150*b* are movable between a latched position and unlatched position. In the illustrated embodiment, body 146 of the latch 116 is configured to rotate about an axis 157 extending through pivot points 158*a* and 158*b* of the body 146 to thereby rotate latch pins 150*a* and 150*b* (about the respective pivot points 158*a* and 158*b*) between the latched position and the unlatched position. The latch arms 152*a* and 152*b* of the body 146 include respective pivot members 160*a* and 160*b* that cooperate with the housing 118 (shown in FIGS. 6 and 8) of the electrical connector 112 to enable the body 146 to rotate about the pivot points 158*a* and 158*b*. The pivot points 158*a* and 158*b* are defined by geometric centers of the pivot members 160*a* and 160*b*, respectively. Although shown as being located at approximately a center of the lengths of the latch arms 152*a* and 152*b*, the pivot members 160*a* and 160*b* additionally or alternatively may be located at any other location along the length of the respective latch arms 152*a* and 152*b*. In the illustrated embodiment, the pivot members 160*a* and 160*b* are each curved protrusions that are complementary with a corresponding pivot member 177 (shown in FIG. 8) of the housing 118. Any other arrangements, configurations, geometries, and/or the like may be used in addition or alternative to the illustrated embodiments of the pivot members 160*a* and 160*b*.

In the illustrated embodiment, the actuator 148 extends from the end 156*a* to the end 156*b* of the latch arms 152*a* and 152*b*, respectively. But, additionally or alternatively the actuator 148 may extend from any other location along the lengths of the latch arms 152*a* and 152*b*. The actuator 148 includes base members 162*a* and 162*b* that extend from the latch arms 152*a* and 152*b*, respectively. The actuator 148 includes a bar 165 that extends a length from the base member 162*a* to the base member 162*b*. The bar 165 thus extends between the base members 162*a* and 162*b*. The actuator bar 165 is configured to rotate about the axis 157 to thereby rotate the latch pins 150*a* and 150*b* between the latched and unlatched position. Each of the base members 162*a* and 162*b* may be referred to herein as a "first" and/or a "second" base member.

The various components of the body 146 of the latch 116 are integrally fabricated from the same sheet of material as a continuous structure such that the body 146 is a single, unitary body. For example, the actuator 148, the latch arms 152*a* and 152*b*, and the latch pins 150*a* and 150*b* are integrally fabricated from the same sheet of material as a continuous structure such that the body 146 is a single, unitary body. In some embodiments, the body 146 is a cut and formed body. Moreover, in some embodiments, the body 146 is a stamped and formed body that is stamped from a sheet of material. Optionally, any other type and/or number of forming methods optionally may be used in addition to the stamping process (es) to fabricate the body 146 as a stamped and formed body. Integrally fabricating the various components of the body 146 from the same sheet of material as a continuous structure such that the body 146 is a single, unitary body, for example using a cutting and forming process, may reduce a cost of the electrical connector 112, for example as compared to at least some known electrical connectors that include latches.

The latch 116 includes one or more return springs 164 operatively connected with the body 146 of the latch 116 such that the return spring(s) 164 is configured to bias the latch pins 150*a* and 150*b* to the latched position. The latch 116 may include any number of the return springs 164. In the illustrated embodiment, the latch 116 includes two return springs 164*a* and 164*b*. Each return spring 164 includes a body 166 having a base 168 and a spring finger 170 that extends outward from the base 168 to a free end 172 of the spring finger 170. An engagement surface 174*a* of the free end 172*a* of the return spring 164*a* is configured to engage in physical contact with the latch arm 152*a* to bias the latch pins 150*a* and 150*b* to the latched position. Similarly, an engagement surface 174*b* of the free end 172*b* of the return spring 164*b* is configured to engage in physical contact with the latch arm 152*b* to bias the latch pins 150*a* and 150*b* to the latched position. Any other geometry, configuration, arrangement, type of spring, and/or the like may be used in addition or alternatively to the illustrated embodiment of the body 166 of the return spring 164.

Optionally, the various components of the body 166 of the return spring 164 are integrally fabricated from the same sheet of material as a continuous structure such that the body 166 is a single, unitary body. For example, the base 168 and the spring finger 170 may be integrally fabricated from the same sheet of material as a continuous structure such that the body 166 is a single, unitary body. In some embodiments, the body 166 is a cut and formed body. Moreover, in some embodiments, the body 166 is a stamped and formed body that is stamped from a sheet of material. Optionally, any other type and/or number of forming methods may be used in addition to the stamping process(es) to fabricate the body 166 as a stamped and formed body. Integrally fabricating the various components of the body 166 from the same sheet of material as a continuous structure such that the body 166 is a single, unitary body, for example using a cutting and forming process, may reduce a cost of the electrical connector 112, for example as compared to at least some known electrical connectors that include latches.

Figure 8:
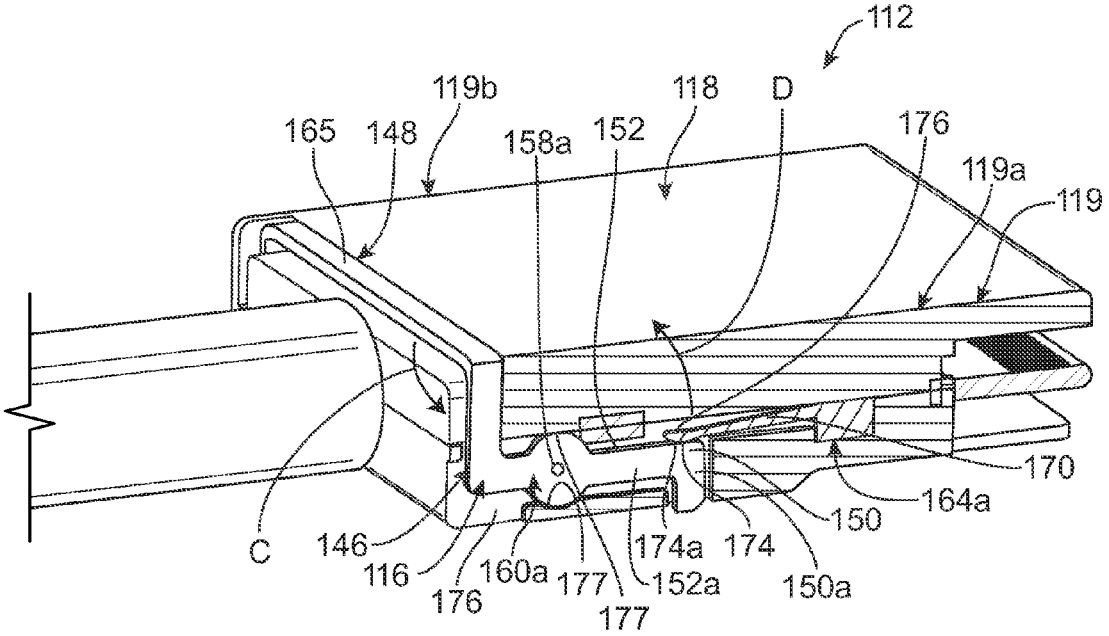
FIG. 8 is a partially cut-away perspective view of the electrical connector shown in FIG. 6 illustrating the latch shown in FIG. 7 mounted thereto.

FIG. 8 is a partially cut-away perspective view of the electrical connector 112 illustrating the latch 116 mounted thereto. The housing 118 has been cut-away in FIG. 8 to illustrate a cross-section of the sidewall 119*a*. As shown in FIG. 8, the sidewall 119*a* includes one or more internal cavities 176. The sidewall 119*a* includes a pivot member 177 that cooperates with the pivot member 160*a* of the latch arm 152*a* to enable the body 146 of the latch 116 to rotate about the pivot point 158*a*. In the illustrated embodiment, the pivot member 177 is a cradle that is complementary with the pivot member 160*a* for receiving the pivot member 160*a* therein. Any other arrangements, configurations, geometries, and/or the like may be used in addition or alternative to the illustrated embodiment of the pivot member 177.

The return spring 164*a* and at least portions of the latch pin 150*a* and the latch arm 152*a* are held within the internal cavity 176 of the sidewall 119*a*. The pivot member 160*a* of the latch arm 152*a* is received within the cradle of the pivot member 177 such that the body 146 of the latch 116 is configured to rotate about the pivot point 158*a*. As should be appreciated from the above description of the sidewall 119*a* and a comparison of FIGS. 6 and 8, the return spring 164*a* can be considered to be embedded within the sidewall 119*a* because the return spring 164*a* is received within the internal cavity 176 of the sidewall 119*a*. The portions of the latch pin 150*a* and the latch arm 152*a* that extend within the internal cavity 176 of the sidewall 119*a* can also be considered to be embedded within the sidewall 119*a*. As shown in FIG. 8, the engagement surface 174*a* of the spring finger 170 of the return spring 164*a* is engaged in physical contact with the body 146 of the latch 116, and specifically with the latch arm 152*a*, within the internal cavity 176 of the sidewall 119*a*.

The other sidewall 119*b* of the housing 118 is substantially similar to the sidewall 119*a* and therefore will not be described in more detail herein. The return spring 164*b* (shown in FIG. 7) and the latch arm 52*b* (shown in FIG. 7) are received within the sidewall 119*b* in a substantially similar manner as the manner described above with respect to the sidewall 119*a*. The latch arm 152*b* cooperates with the housing 118 at the sidewall 119*b* in a substantially similar manner to the manner described above with respect to the latch arm 152*a*, which enables the body 146 of the latch 116 to rotate about the pivot points 158*a* and 158*b* (shown in FIG. 7).

Embedding the latch arms 152, the latch pins 150, and/or the return springs 164 within the sidewalls 119 may reduce the size of the electrical connector 112, for example as compared to at least some known electrical connectors that include latches. Moreover, embedding the latch arms 152, the latch pins 150, and/or the return springs 164 within the sidewalls 119 may improve the form factor of the electrical connector 112 as compared to at least some known electrical connectors that include latches. For example, embedding the latch arms 152, the latch pins 150, and/or the return springs 164 within the sidewalls 119 may prevent, or reduce the occurrence of snagging the electrical connector 112 on other objects, structures, and/or the like. Embedding the latch arms 152, the latch pins 150, and/or the return spring 164 within the sidewalls 119 may improve the aesthetics of the electrical connector 112 as compared to at least some known electrical connectors that include latches.

The latch pins 150*a* and 150*b* (shown in FIG. 3) are shown in the latched position in FIG. 8, with the spring fingers 170 of the return springs 164*a* and 164*b* (shown in FIG. 3) in the natural resting positions thereof. As shown in FIG. 8, when the spring finger 170 is in the natural resting position, the engagement surface 174 of the spring finger 170 is engaged in physical contact with the corresponding latch arm 150 such that the spring finger 170 biases the latch pins 150*a* and 150*b* to the latched position.

To move the latch 116 from the latched position shown in FIG. 8 to the unlatched position, the actuator bar 165 is pushed in the general direction of the arc C such that the actuator 148 rotates about the pivot points 158*a* and 158*b* along the arc C, which rotates the latch pins 150*a* and 150*b*, against the bias of the spring fingers 170, about the pivot points 158*a* and 158*b* along the arc D from the latched position to the unlatched position. The latch 116 is thus a push latch wherein the actuator 148 is configured to be pushed to unlatch the latch 116. The actuator bar 165 may be pushed in the direction of the arc C using any portion of a person's hand (e.g., a finger, thumb, and/or the like) and/or using a suitable tool. In other embodiments, the actuator 148 is configured to be pulled to unlatch the latch 116 such that the latch 116 is a pull latch (e.g., see the latch 16 shown in FIGS. 1-5).

Although shown as being used with the particular electrical connectors 12, 14, and 112, the latch embodiments shown and/or described herein may be used with any other type of electrical connector. One specific example of another type of electrical connector with which the latch embodiments shown and/or described herein may be used is a pluggable transceiver module (not shown).

The latch embodiments described and/or illustrated herein may provide a relatively robust, reliable, and/or cost effective latch that is biased to the latched position in a minimal envelope.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A latch for latching a connector to a device, the latch comprising:

a body comprising an actuator, a latch arm extending from the actuator, and a latch pin extending downward from the latch arm; the latch pin being movable between a latched position and an unlatched position, wherein the latch pin is configured to latch the connector to the device when the latch pin is in the latched position, the actuator being configured such that movement of the actuator moves the latch arm to move the latch pin between the latched position and the unlatched position; and a return spring positioned adjacent the body, the return spring engaging a top of the latch arm to force the latch arm downward to spring bias the latch pin in the latched position;

wherein the actuator, the latch arm, and the latch pin are integrally fabricated from a same sheet of material as a continuous structure such that the body is a single, unitary body.

2. The latch of claim 1, wherein the body is a stamped and formed body that is stamped from the sheet of material.

3. The latch of claim 1, wherein the return spring operatively engages the top of the latch arm directly above the latch pin such that the return spring is configured to bias the latch pin downward to the latched position.

4. The latch of claim 1, wherein the actuator extends out of the plane of the latch arm and wherein the return spring is aligned coplanar with the latch arm and the latch pin, the return spring comprising a body fabricated from a sheet of material as a single, unitary body.

5. The latch of claim 1, wherein the actuator is configured to rotate about a pivot point of the body, and wherein rotation of the actuator about the pivot point rotates the latch pin about the pivot point between the latched position and the unlatched position.

6. The latch of claim 1, wherein the latch arm is a first latch arm, the latch pin is a first latch pin, and the return spring is a first return spring, the body further comprising a second latch arm extending from an opposite side of the actuator as the first latch arm and a second latch pin extending downward from the second latch arm, wherein the latch further comprises a second return spring engaging the top of the second latch arm, the actuator comprising first and second base members that extend from the first and second latch arms, respectively, and the actuator comprising a bar that extends between the first and second base members.

7. The latch of claim 1, wherein the actuator is configured to be pulled to move the latch pin from the latched position to the unlatched position; and wherein the actuator is configured to be pushed to move the latch pin from the latched position to the unlatched position.

8. The latch of claim 1, wherein the body is configured to rotate about a pivot axis through a pivot member, the actuator being positioned above the pivot axis, the latch pin being positioned below the pivot axis.

9. An electrical connector comprising:

a housing;

an electrical contact assembly held by the housing; and a latch mounted to the housing for latching the electrical connector to a device, the latch comprising:

a body comprising an actuator, a latch arm extending from the actuator, and a latch pin extending downward from the latch arm, the latch pin being movable between a latched position and an unlatched position, wherein the latch pin is configured to latch the electrical connector to the device when the latch pin is in the latched position, the actuator being configured such that movement of the actuator moves the latch arm to move the latch pin between the latched position and the unlatched position; and a return spring positioned adjacent the body, the return spring engaging a top of the latch arm to force the latch arm downward to spring bias the latch pin in the latched position;

wherein the actuator, the latch arm, and the latch pin are integrally fabricated from a same sheet of material as a continuous structure such that the body is a single, unitary body.

10. The electrical connector of claim 9, wherein the body is a stamped and formed body that is stamped from the sheet of material.

11. The electrical connector of claim 9, wherein the return spring operatively engages the top of the latch arm directly above the latch pin such that the return spring is configured to bias the latch pin downward to the latched position, wherein the actuator extends out of the plane of the latch arm and wherein the return spring is aligned coplanar with the latch arm and the latch pin, the return spring comprising a body fabricated from a sheet of material as a single, unitary body.

12. The electrical connector of claim 9, further comprising the return spring operatively connected with the body such that the return spring is configured to bias the latch pin to the latched position, the return spring being embedded within a sidewall of the housing.

13. The electrical connector of claim 9, wherein at least a portion of the latch arm, at least a portion of the latch pin, and at least a portion of the return spring being embedded within a sidewall of the housing such that the sidewall is exterior thereof.

14. The electrical connector of claim 9, wherein the actuator is configured to rotate about a pivot point of the body, and wherein rotation of the actuator about the pivot point rotates the latch pin about the pivot point between the latched position and the unlatched position.

15. The electrical connector of claim 9, wherein the latch arm is a first latch arm, the latch pin is a first latch pin, and the return spring is a first return spring, the body further comprising a second latch arm extending from an opposite side of the actuator as the first latch arm and a second latch pin extending downward from the second latch arm, wherein the latch further comprises a second return spring engaging the top of the second latch arm, the actuator comprising first and second base members that extend from the first and second latch arms, respectively, and the actuator comprising a bar that extends between the first and second base members.

16. The electrical connector of claim 9, wherein the body is configured to rotate about a pivot axis through a pivot member, the actuator being positioned above the pivot axis, the latch pin being positioned below the pivot axis.

17. The electrical connector of claim 9, wherein the housing includes a sidewall having an exterior surface, and wherein the latch arm, the latch pin, and the return spring are embedded within the sidewall of the housing such that the exterior surface of the sidewall is outside of and covers the latch arm, the latch pin, and the return spring.

18. An electrical connector comprising:

a housing comprising first and second sidewalls on opposite sides of the housing, the first and second sidewalls having exterior surfaces;

an electrical contact assembly held by the housing; and a latch mounted to the housing for latching the electrical connector to a device, the latch comprising:

a body comprising an actuator, first and second latch arms extending from the actuator, and first and second latch pins extending from the first and second latch arms; the first and second latch pins being movable between a latched position and an unlatched position, wherein the first and second latch pins are configured to latch the electrical connector to the device when in the latched position, the actuator being configured such that movement of the actuator moves the first and second latch arms to move the first and second latch pins between the latched position and the unlatched position;

a first return spring operatively connected with the body such that the first return spring is configured to bias the first latch pin to the latched position, wherein the first latch arm, the first latch pin, and the first return spring are embedded within the first sidewall of the housing; and a second return spring operatively connected with the body such that the second return spring is configured to bias the second latch pin to the latched position, wherein the second latch arm, the second latch pin, and the second return spring are embedded within the second sidewall of the housing.

19. The electrical connector of claim 18, wherein the first return spring is configured to engage in physical contact with a top of the first latch arm within the first sidewall of the housing, and wherein the second return spring is configured to engage in physical contact with a top of the second latch arm within the second sidewall of the housing.

20. The electrical connector of claim 18, wherein the first return spring is coplanar with the first latch arm, and wherein the second return spring is coplanar with the second latch arm.

* * * * *